United States Patent [19]

Coggins et al.

[11] Patent Number: 4,601,780

[45] Date of Patent: Jul. 22, 1986

[54] PROCESS OF RECOVERING ALUMINUM ETCHANT

[75] Inventors: Dolphus L. Coggins; Walter E. Lindner, both of St. Louis, Mo.

[73] Assignee: McDonnell Douglas Corporation, St. Louis, Mo.

[21] Appl. No.: 682,274

[22] Filed: Dec. 17, 1984

[51] Int. Cl.[4] ..... C23F 1/02; B44C 1/22; C03C 15/00; C03C 25/06

[52] U.S. Cl. ..... 156/642; 156/659.1; 156/665; 156/345; 252/79.5

[58] Field of Search ..... 156/642, 659.1, 665, 156/345; 134/13; 252/79.5

[56] References Cited

U.S. PATENT DOCUMENTS 3,607,482 9/1971 Selm ..... 156/642
3,712,838 1/1973 Weissenberg ..... 156/642

*Primary Examiner*—William A. Powell
*Attorney, Agent, or Firm*—Gravely, Lieder & Woodruff

[57] ABSTRACT

This application involves a continuous process for chemical milling of aluminum by recovering caustic from an etch tank solution by treating the solution having dissolved metals and other contaminants with calcium oxide and barium compounds to form precipitates which are separated by centrifugation to permit recovery and reuse of the caustic.

19 Claims, 1 Drawing Figure

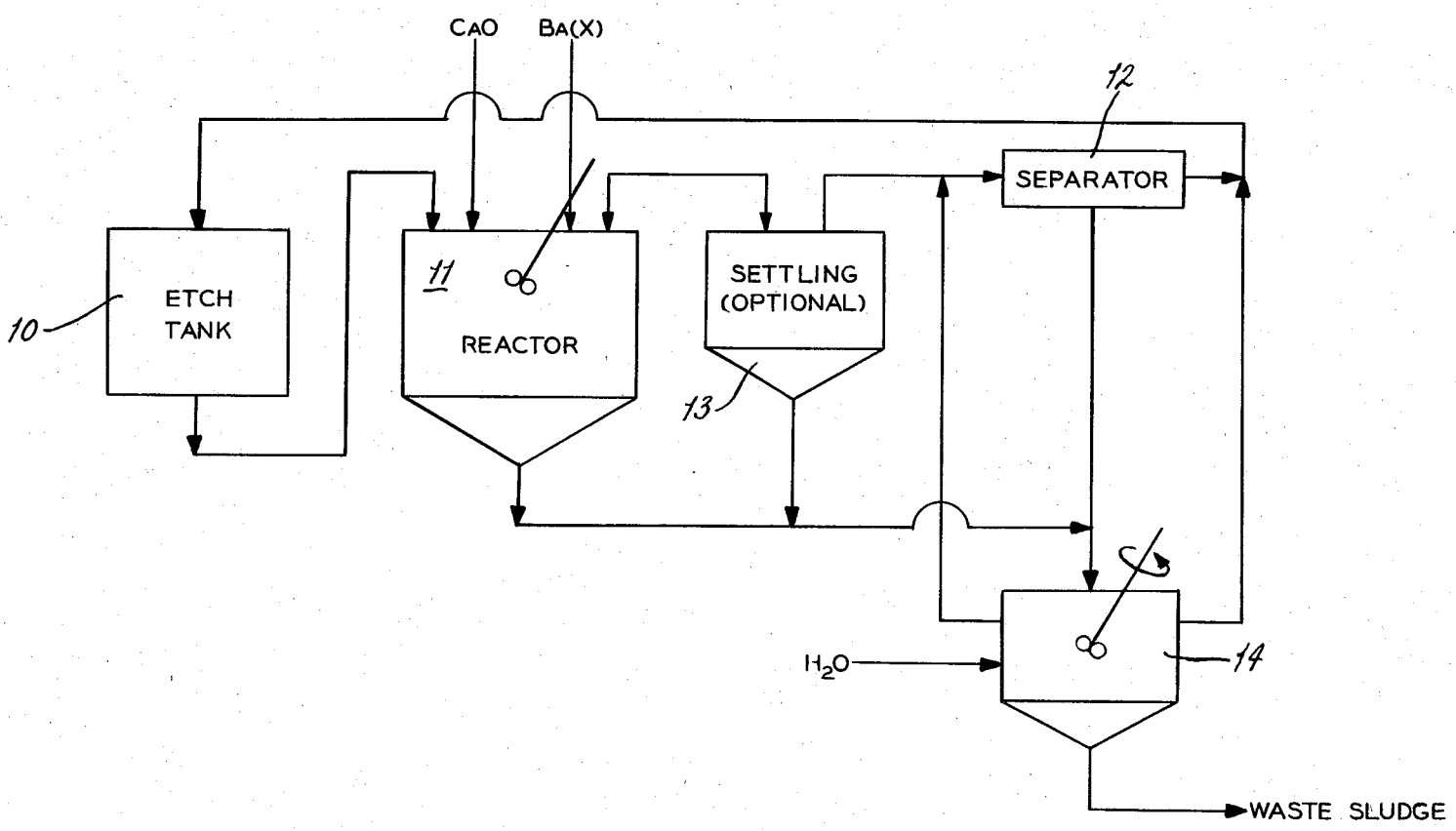
CaO
Ba(X)
ETCH TANK
10
REACTOR
11
SEPARATOR
12
SETTLING (OPTIONAL)
13
14
$H_2O$
WASTE SLUDGE

PROCESS OF RECOVERING ALUMINUM ETCHANT

BACKGROUND OF THE INVENTION

The present invention relates to chemical milling of metals and is particularly related to a process for recovering the etchant used in treating aluminum and aluminum alloys.

Conventionally chem-milling of aluminum in the aircraft industry involves reacting the part to be milled with a solution which contains sodium hydroxide (NaOH) as the basis of the etchant. One major problem with chem-milling compositions of this type, which have sodium hydroxide as their base is that the solution does not produce an acceptable part when the dissolved metal reaches about 60–70 g/l of solution. This is caused by interference of the reaction by-products with the chem-milling reaction.

The typical aluminum etchant reaction is:

$$2Al+2NaOH+2H_2O \rightarrow 2NaAlO_2+3H_2 \uparrow$$

The amount of $NaAlO_2$ in the etching solution is what eventually causes the chem-milling solution in the tank to become deficient in regards to the finish imparted to the surface of the part being milled.

Aluminum chemical milling has, since its inception, been a batch process. That is, starting with fresh solution, metal is dissolved to a total ionic content of between 60–70 g/l and then no longer provides good chem-mill characteristics and has to be discarded. At this time large amounts of caustic are lost. Costs are also incurred in the hauling and disposal of such etchants. Numerous attempts to recover both dissolved aluminum and sodium hydroxide based upon precipitation techniques have been tried. This recovery is highly desirable and some techniques have been reported in the patent literature.

U.S. Pat. No. 2,975,041 to Holman alleges an etching process for aluminum which also provides for at least partial regeneration of spent caustic etching solutions. This process comprises contacting aluminum with an alkaline solution to etch or mill the metal. In this conventional operation, the free alkalinity of the etching solution is reduced and the aluminum values in solution are increased. A principal teaching of this patent is to cool the spent etching solution so as to precipitate hydrated alumina therefrom. If an insubstantial amount of solid phase hydrate alumina is formed to effect precipitation, a sufficient amount of solid phase hydrated alumina is added to the spent etching solution to cause a thorough contact between the solution and the dispersed solid alumina hydrate. The resulting cooled solution is allowed to stand for an extended period of time whereby hydrated alumina precipitates therefrom and the supernatant solution is separated by settling of the solids and decanting of the clear solution. According to this patent, "the solution shows an increase in the free alkali and a decrease in the amount of the aluminate in solution." This process for regenerating spent aluminum etching solution suffers from the disadvantages that the solution must be cooled, many times undesirable solids must be added to the etching bath, lengthy storage times must be utilized and there is no real control of the degree and quality of the regenerated bath.

Weissenberg U.S. Pat. No. 3,712,838 discloses a process of regenerating spent caustic liquor involving contacting the hot spent caustic bath with calcium oxide to precipitate aluminum values present in the spent liquor and regenerate hydroxyl ions. The precipitate is removed from the regenerated solution. The calcium oxide reacts with the aluminate values in the spent caustic solution to provide a substantially insoluble, readily removable solid, calcium aluminate precipitate. In addition to aluminate removal, Weissenberg also states his process regenerates the hydroxyl ion concentration in the caustic solution due to the calcium oxide reacting with the soluble anions in the spent solution to form an insoluble calcium salt and free hydroxyl ions. These anions are introduced into the solution during the etching operation. The solids are removed from the solution and the regenerated caustic values ordinarily returned to the etching process for reuse.

Both of the foregoing processes are theoretically of interest, but cannot be used on a continuous production basis without severe chemical milling defects, i.e., chattered radii, poor surface finish, and poor chemical milling lines.

It is believed that these production problems are caused by etch solution additives, alloying elements in the etched material, and organic and inorganic contaminants deriving from sources, such as, maskants and resists, used in the chemical milling procedure.

We have discovered that by adding calcium oxide and a barium salt to a depleted chemical milling solution, pure sodium hydroxide and unreacted sulfides can be removed for reuse in a chemical milling process on a substantially continuous basis.

We have developed an aluminum etchant rejuvenation system which precipitates accumulated dissolved aluminum, silicates and organic contaminants. The contaminants occur due to chem-mill "maskant" exposure in high caustic environments. In the chemical reactions associated with this process, caustic (NaOH) is generated which compensates for losses during metal precipitation. The process uses lime and barium salts, i.e., $BaCl_2$, $Ba(NO_3)_2$, etc.

The other materials are removed by a proper separation technique, i.e., centrifugation, filtration, or the like as precipitates or sol-precipitates. These include the dissolved aluminum in the form of $Ca(AlO_2)_2$ and the silicate compounds, other metallic salts (from the alloying compounds) and the organics in the form of barium compounds as sol-precipitates.

Accordingly, it is a principal object of the present invention to provide a novel method for regenerating spent caustic aluminum etching solutions.

It is another object of the present invention to provide a process for regenerating spent caustic etching solutions wherein the solution is treated at its normal operating conditions.

Still another object is to provide a continuous process for chemically milling aluminum in which the spent etchant is recovered and the usable caustic rejuvenated on a continuous basis.

Other objects and advantages of the present invention include saving chemical cost by 70–80% recovery of unused sodium hydroxide; providing a continuous process and operating over a much narrower range of dissolved metal content, thus proving improved etch rate control; providing more uniform tank conditions and alleviating surfaced fillet variations on parts caused by the wide operating range of a batch operation; and saving in waste collection, hauling and storage costs.

These and other objects and advantages will become apparent hereinafter.

SUMMARY OF THE INVENTION

The present invention is a continuous process for etching aluminum in which spent etchant is treated with calcium oxide and barium salts to allow recovery and reuse of caustic.

DESCRIPTION OF THE DRAWING

The attached drawing is a flow sheet depicting the present invention.

DETAILED DESCRIPTION

As mentioned, the typical aluminum etching reaction is:

$$2Al+2NaOH+2H2O \rightarrow 2NaAlO_2+3H_2 \uparrow$$

The production of $NaAlO_2$ and its buildup in the etching solution in the tank is what eventually causes the tank to cease producing satisfactory surface finish on etched parts.

When the concentration of $NaAlO_2$ is at 50–70 g/l of etch solution, the solution normally is discarded in a batch operation. We have found that adding from about 0.2 to about 0.36 lb/gal of calcium oxide and about 0.02 to about 0.06 lb/gal of barium salt allows the recovery of 95–100% of the NaOH in the original etch solution, albeit in a more diluted form.

In the flow diagram, the etch solution is made up in the etch tank 10 and contains about 25 to about 35 gal of 50% commercial grade NaOH per 100 gal of etchant, about 1.5 to about 6 gal triethanolamine 98% grade per 100 gal of etchant, and about 2 to about 6 gal sulfides per 100 gal etchant. The sulfides are commercially available in the form of NaS (sodium sulfide) made by chemical manufacturers or a liquid sulfide solution from Turco Products, Inc.

This solution is heated to about 200° F. to about 225° F. The etchant make-up and operating temperature may be varied widely depending upon desired metal removal rate, tolerances and surface finish requirements.

After making a new etching solution, chemical milling is conducted in usual manner, until dissolved aluminum content reaches 50–70 g/l of solution. Normally, at this point the solution is considered depleted and would be dumped. Instead of dumping, the depleted solution is pumped into a mixing chamber (reactor) to which the recovery solutions are added and the rejuvenation reaction takes place.

About 20 to about 36 lbs/CaO per 100 gal of etchant and about 2 to about 6 lbs/barium salt per 100 gal etchant are added in the reactor 11 with stirring. The lime reacts in the following manner.

$$CaO+H_2O \rightarrow Ca(OH)_2+\text{heat}$$

$$Ca(OH)_2+NaAlO_2 \rightarrow Ca(AlO_2)_2+2NaOH$$

The barium reacts with silicate compounds, other metallic salts and organics to form a sol-precipitate. This reaction scheme is kinetically active and has to be allowed the proper time to react. The caustic laden slurry is separated and the liquor returned to the etch tank. Although somewhat diluted of caustic (free hydroxide) compared with original solution, 95–100% of the sodium hydroxide is recovered and reused, compared to that ordinarily discarded.

The time of the reaction in the reactor 11 is from about 10 to about 60 min.

The separation preferably is by centrifugation 12 but there can be an intermediate settling operation in a settling tank 13 where the solids are separated and passed to a disposal tank or optional wash tank 14.

The solids from the separator 12 also are disposed of or optionally treated in the wash tank 14 with water to remove any additional caustics before disposal of the sludge.

EXAMPLE NO. 1

The following is a specific detailed disclosure of a preferred process of chemically milling aluminum and aluminum alloys, specifically 2024-T3 and 7075-T6 alloys.

Aluminum panels, 3×4×0.1 inch of 2024-T3 and 7075-T6 alloys were cleaned, coated with a proprietary maskant, scribed and the appropriate maskant removed to produce a 3×1 inch surface area for milling. The foregoing procedures all are standard in the industry and are well known to those working in the aluminum chem-milling field.

Six liters of the following standard aluminum chem-mill solution were prepared:

| | |
|---|---|
| 50% NaOH solution | 24% by vol. |
| Sulfides | 2% by vol. |
| Triethanolamine | 2% by vol. |

A chemical milling tank was half filled with tap water. Then the other materials specified were added. The balance of water was added to bring the tank to its operating level. The solution was mixed thoroughly using compressed air. Then the air was turned off and the tank was heated to operating temperature. TFE Defoamer No. 4 (Turco Products, Inc.) may be added at 0.12 oz/100 gal of solution as needed to prevent excessive foaming when chem-milling large skins. The solution is used to chemically mill material until a concentration of 50 g/l of dissolved metal is reached where a portion of the etchant is passed to the reactor and make-up etchant material is added. The make-up etchant material can be recycled from the separator in a continuous process with only those new additives necessary to maintain the etch composition at the desired concentration. The etch material removed from the etch tank is treated with 0.26 lb CaO/gal of etchant and 0.055 lb $Ba(Cl)_2$/gal of etchant for 30 minutes in the reactor. The slurry is settled for 30 minutes in the settling tank and the effluent is passed to a centrifuge. These tanks are run on a continuous overlow basis with the average hold time being the 30 minutes noted. The solids are moved to a wash tank where the solids from the centrifuge are joined and washed with water. The liquid from the centrifuge is returned to the etch tank as make-up etchant after suitable adjustments in composition. The wash water also contains caustic and can be reused.

While we have described a particular embodiment of my invention for the purpose of illustration, it should be understood that various modifications and adaptations thereof may be made within the spirit of the invention as set forth in the appended claims.

What is claimed is:

1. A process for regenerating used caustic aluminum etchant solution comprising the steps of treating caustic solution containing dissolved aluminum and other contaminants from alloy elements and maskant by-products with calcium oxide and barium salt, reacting the dissolved metal and contaminants with the calcium oxide and barium salt to produce precipitates, and separating the caustic containing fluid from the said precipitates.

2. The process of claim 1 wherein the calcium oxide and barium salt are added to the caustic aluminum etchant solution at a temperature of about 150° F. to about 220° F.

3. The process of claim 1 wherein the calcium oxide and barium salt are allowed to react with the caustic aluminum etchant solution for at least about 10 min before separation of the caustic containing fluid.

4. The process of claim 1 including the step of washing the precipitates with water after separation and returning the wash water to the caustic containing fluid from the separation.

5. The process of claim 1 wherein the separation is by centrifugation.

6. The process of claim 1 wherein the separation is by filtration.

7. A process for chemically milling aluminum on a continuous basis comprising the steps of:

(a) forming a chemical milling solution containing caustic and up to about 70 g/l dissolved metal in a first tank, (b) removing at least a portion of the chemical milling solution from the said first tank and treating it with calcium oxide and a barium salt, (c) separating the caustic containing fluid from the treatment with calcium oxide and barium salts, and (d) returning said caustic to the said first tank.

8. The process of claim 7 including the step of forming precipitates with the calcium oxide and the barium salt and the dissolved materials in the caustic containing solution and then separating the precipitates from the caustic containing fluid for reuse.

9. The process of claim 8 wherein the separation is by centrifugation.

10. The process of claim 7 wherein the chemical milling solution is at about 150° F. to about 220° F. when the calcium oxide and barium salt are added.

11. The process of claim 7 wherein the calcium oxide and barium salt are reacted for about 10 to about 60 min before the caustic containing fluid is separated.

12. The process of claim 8 wherein the precipitates are washed with water to remove caustic adhered thereto.

13. The process of claim 12 wherein the wash water is returned to the etch tank.

14. The process of claim 1 wherein the barium salt is selected from the group consisting of barium nitrate and barium chloride.

15. The process of claim 7 wherein the barium salt is selected from the group consisting of barium nitrate and barium chloride.

16. A process for chemically milling aluminum or aluminum parts on a continuous basis comprising the steps of:

(a) cleaning aluminum or aluminum alloy parts to be chemically milled, (b) coating the parts with a maskant containing silicate or organic constituents, (c) scribing the parts and removing maskant from the areas to be milled, (d) chemically milling the parts with a caustic chemically milling solution until a chemical milling solution containing caustic and up to about 70 g/l dissolved metal is formed in a first tank, (e) removing at least a portion of the chemical milling solution from the said first tank and treating it with calcium oxide and a barium salt, (f) forming precipitates with the calcium oxide and the barium salt and the dissolved materials in the caustic containing solution, (g) separating the precipitates from the caustic containing fluid, and (h) returning said caustic to the said first tank.

17. The process of claim 16 wherein the calcium oxide and barium salt are reacted for about 10 to about 60 min before the caustic containing fluid is separated.

18. The process of claim 16 wherein the calcium oxide reacts with the $NaAlO_2$ to regenerate NaOH and the barium salt reacts with the silicate or organics to remove these from solution.

19. The process of claim 16 wherein the barium salt is selected from barium nitrate and barium chloride.

* * * * *